US010309301B2

(12) United States Patent
Gebhart et al.

(10) Patent No.: US 10,309,301 B2
(45) Date of Patent: Jun. 4, 2019

(54) CONSTANT-VOLUME COMBUSTION ENGINE

(71) Applicant: Baustoffwerke Gebhart & Soehne GmbH & Co. KG, Aichstetten (DE)

(72) Inventors: Friedrich Gebhart, Memmingen (DE); Richard Maier, Memmingen (DE)

(73) Assignee: Baustoffwerke Gebhart & Soehne GmbH & Co. KG, Aichstetten (DE)

( * ) Notice: Subject to any disclaimer, the term of this patent is extended or adjusted under 35 U.S.C. 154(b) by 146 days.

(21) Appl. No.: 15/101,836

(22) PCT Filed: Dec. 3, 2014

(86) PCT No.: PCT/EP2014/076351
§ 371 (c)(1),
(2) Date: Jun. 3, 2016

(87) PCT Pub. No.: WO2015/082517
PCT Pub. Date: Jun. 11, 2015

(65) Prior Publication Data

US 2016/0333779 A1 Nov. 17, 2016

(30) Foreign Application Priority Data

Dec. 6, 2013 (DE) ..... 10 2013 225 147

(51) Int. Cl.
*F02B 75/04* (2006.01)
*F01B 1/10* (2006.01)
(Continued)

(52) U.S. Cl.
CPC ..... *F02B 75/04* (2013.01); *F01B 1/10* (2013.01); *F01B 9/042* (2013.01); *F02B 75/32* (2013.01);
(Continued)

(58) Field of Classification Search
CPC ..... F02B 75/04; F01B 1/10; F01B 9/042
See application file for complete search history.

(56) References Cited

U.S. PATENT DOCUMENTS 5,158,047 A * 10/1992 Schaal ..... F01B 9/02 123/197.4
5,309,779 A 5/1994 Sarno
(Continued)

FOREIGN PATENT DOCUMENTS

DE 440465 C 2/1927
DE 4013754 A1 10/1991
(Continued)

OTHER PUBLICATIONS

Gondiant, Sophie, "International Search Report and Written Opinion re Application No. PCT/EP2014/076351", Jun. 2, 2015, p. 14 Published in: EP.

*Primary Examiner* — Kevin A Lathers
(74) *Attorney, Agent, or Firm* — Neugeboren O'Dowd PC

(57) ABSTRACT

The invention relates to a constant-volume combustion engine (10; 110; 210), in particular a reciprocating engine for generating mechanical energy by the expansion of a gas or a hot gas from the combustion of a gas mixture or gas-fuel mixture, having at least one piston/cylinder unit, the piston (14; 114; 214) of which is connected to a piston rod (20; 120; 220), wherein said piston rod (20; 120; 220) is drivingly connected to at least two crankshafts (30, 40; 130, 140; 230*a*, 230*b*, 240), the first crankshaft (40; 140; 240) being mounted, such that it can rotate eccentrically, on the second crankshaft (30; 130; 230*a*, 230*b*), which is parallel thereto and is rotationally coupled thereto.

12 Claims, 6 Drawing Sheets

Figure 1A:
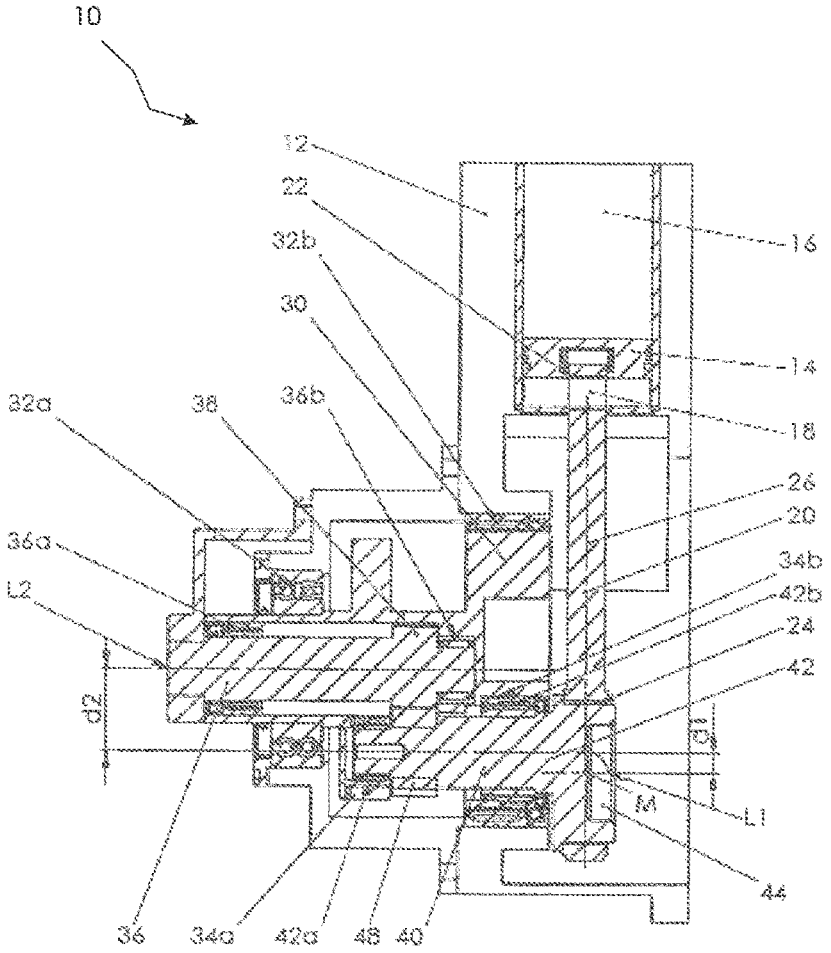

(51) Int. Cl.

| | |
|---|---|
| ***F01B 9/04*** | (2006.01) |
| ***F02B 75/32*** | (2006.01) |
| *F02B 75/06* | (2006.01) |

(52) U.S. Cl.
CPC ..... *F01B 2009/045* (2013.01); *F02B 75/065* (2013.01)

(56) References Cited

U.S. PATENT DOCUMENTS

| | | | |
|---|---|---|---|
| 2005/0221945 | A1 | 10/2005 | Plath |
| 2008/0210026 | A1 | 9/2008 | Chio |

FOREIGN PATENT DOCUMENTS

| | | | |
|---|---|---|---|
| DE | 20308685 | U1 | 9/2003 |
| DE | 102007033909 | A1 | 2/2009 |
| DE | 102009005447 | A1 | 7/2010 |
| DE | 102013225147 | A1 | 6/2015 |
| EP | 1905983 | A1 | 4/2008 |
| FR | 2955149 | A1 | 7/2011 |
| GB | 2053352 | A | 2/1981 |
| WO | 9005862 | A1 | 5/1990 |
| WO | 9726452 | A1 | 7/1997 |
| WO | 0102752 | A1 | 1/2001 |
| WO | 2015082517 | A2 | 6/2015 |

* cited by examiner

CONSTANT-VOLUME COMBUSTION ENGINE

The invention relates to a constant-volume combustion engine, in particular a reciprocating piston engine, in accordance with the preamble of patent claim 1.

In addition, the invention relates to a method for operating a constant-volume combustion engine in accordance with the preamble of claim 11 and to the use of a constant-volume combustion engine as claimed in claims 16 and 17.

Reciprocating piston engines are well known in a multiplicity of different embodiments from the prior art.

For instance, French patent application FR 2 955 149 A1 discloses a combustion engine which has at least one piston/cylinder unit, the piston being connected movably to two crankshafts via two piston rods. Here, the two piston rods jointly drive the associated piston. The two crankshafts which are associated to a piston are for their part provided with a gearwheel, the two gearwheels of the two crankshafts of a piston being in engagement with one another and rolling on one another. As a result of the arrangement of the crankshafts of a piston which are oriented in parallel, the relaxation stroke, that is to say the displacement of the piston from the top dead center to the bottom dead center, is extended, namely from 180° to from 220 to 225°, whereas the compression stroke, that is to say the displacement of the piston from the bottom dead center to the top dead center, is shortened from 180° to 135°.

Similar arrangements are also known from DE 40 13 754 A1 and DE 10 2009 005 447 A1.

English patent application GB 2 053 352 A discloses a four stroke engine, in which two crankshafts are likewise used to drive the piston. Said crankshafts are coupled to one another in such a way that they rotate relative to one another at a predefined rotational speed ratio of two to one. The connecting rods which are connected to them are fastened in each case with one end to a floating transverse connection and with their other end to the first or second crankshaft. It is also the case in this solution variant that the two crankshafts are rotationally coupled to one another via gearwheels which are arranged in between, chain drives or the like. The fastening points of the piston rods to the respective crankshafts are selected in such a way that, at the beginning of the intake stroke (at this point, the piston of the cylinder is in its uppermost position), the first piston rod is likewise deflected in its uppermost position, whereas the second piston rod is in a position at a phase shift of 90° from the uppermost position. The movement of the floating connection is guided via an arm, with the result that a superimposed movement of the first and the second crankshaft can be transmitted to the connecting rod.

The above-described design variants of reciprocating piston engines are comparatively complicated and accordingly require more installation space than customary reciprocating piston engines with only one connecting rod per piston.

Furthermore, DE 203 08 685 U1 describes a gear apparatus which is configured as a planetary gear mechanism, containing: two parallel tracks, of which one is arranged in a stationary manner and the other is mounted movably, at least one planetary gear which is arranged between the two tracks and is operatively connected to both tracks on its circumference, a bearing axle which can be moved parallel to the two tracks and about which the planetary gear is mounted rotatably, and a power transmission axle, the arrangement being such that, by way of rolling on the track which is arranged in a stationary manner, the planetary gear can transmit both movements of the power transmission axle to the movably mounted track and also, in the reverse direction, movements of the movable track to the power transmission axle. Here, the power transmission axle is arranged eccentrically on the bearing axle.

Furthermore, DE 10 2007 033909 A1 describes a connecting rod length variator engine consisting of a connecting rod length variator and a classic crank mechanism with connecting rod and crankshaft, the classic connecting rod length being extended by way of a connecting rod length variator, without a change of the gudgeon pin position with piston crown on the cylinder axis.

EP 1 905 983 A1 likewise describes an apparatus for generating kinetic energy in a combustion engine. Further relevant documents in respect of the prior art are documents WO 97/26453 A1, WO90/05862 A1, WO 01/02752 A1 and DE 440 465 C, to which reference is also made for the sake of completeness.

Accordingly, one object of the present invention consists in achieving the advantages of the known reciprocating piston engines and at the same time providing a comparatively space-saving construction.

This object is achieved by way of a constant-volume combustion engine having the features of claim 1.

According to said claim, a constant-volume combustion engine, in particular a reciprocating piston engine for generating mechanical energy by way of expansion of a gas or a hot gas from the combustion of a gas mixture or gas/fuel mixture, is proposed, having at least one piston/cylinder unit, the piston of which is connected to a piston rod, the piston rod being drive-connected to at least two crankshafts. Furthermore, according to the invention, the first crankshaft is mounted eccentrically rotatably on the second crankshaft which is arranged parallel to it, and is rotationally coupled to said second crankshaft.

In a customary way, there is an interaction between the driven and driving state between the piston rod and a crankshaft which is connected to it, that is to say the piston rod and the piston which is connected to it are driven by the connected crankshaft depending on the stroke of the engine, such as during the compression stroke, or drive said crankshaft, such as during the power stroke. In the present case, the piston rod is drive-connected to at least two crankshafts, it being possible here for the connection to not be realized directly to the two crankshafts, but rather also to elements which are connected in between or (directly or indirectly) to only one of the two crankshafts, whereas the second crankshaft is rotationally coupled to the first crankshaft and, via the latter, is drive-connected to the piston rod. It is decisive in the case of the drive-connection of the piston rod and the at least two crankshafts that the rotational movements of the crankshafts can be transmitted in a superimposed manner to the piston rod and, in the opposite direction, the movement of the piston rod is transferred to the two crankshafts.

In the context of the present description, "rotationally coupled" is understood to mean a state, in which each of the two crankshafts performs a rotational movement owing to a rotational movement of the respectively other crankshaft. As a result, a superimposed rotational movement is produced which can be transmitted to the drive-connected piston rod and to the piston which is connected to the latter, and it is made possible as a result to generate a virtually constant position of the piston rod and the piston which is connected to it in the piston/cylinder unit over a defined angular section of the overall movement.

The advantage of a virtually constant position of the piston rod of this type can be seen in the fact that the combustion chamber, delimited by way of the piston, of the piston/cylinder unit is kept virtually the same size over the defined angular section, with the result that, for example during the power or combustion stroke of the engine, higher pressure generation is achieved during the combustion of the fuel gas mixture in comparison with conventional reciprocating piston engines. In the ideal case, the defined angular section can be selected in such a way that it covers virtually the entire combustion stroke, with the result that the entire combustion can take place in a combustion chamber of constant size (called the constant-volume process in the following text).

At the same time, however, the necessary installation space of the constant-volume combustion engine is reduced considerably in the present invention in comparison with the solutions which are known from the prior art. This is achieved by way of the eccentric arrangement of the first crankshaft on the second crankshaft.

Furthermore, the rotational coupling of the first crankshaft to the second crankshaft can comprise at least two gearwheels. Here, for example, one gearwheel can be configured on each of the two crankshafts, for example in the form of a spur toothing system, the at least two gearwheels being in engagement with one another and realizing the rotational coupling via this. An embodiment of this type has the advantage that a particularly inexpensive and space-saving solution is produced as a result.

As an alternative, separately configured gearwheels which are likewise in engagement with one another can be arranged on the crankshafts. A space-saving solution can also be provided in an embodiment of this type by way of the arrangement of the gearwheels on the crankshafts.

Finally, in certain applications, at least one of the gearwheels of the rotational coupling can also be arranged on another component of the constant-volume combustion engine, for example on a housing of the constant-volume combustion engine, it being possible for the second gearwheel to roll on said gearwheel, and the rotational coupling being achieved via the two gearwheels and the eccentric mounting of the first crankshaft on the second crankshaft.

It can be provided, furthermore, that the first and the second crankshaft move in opposite directions to one another. Depending on the configurations of the rotational coupling, the first and the second crankshaft can also move in the same direction as one another.

The first and the second crankshaft can move relative to one another at a predefined rotational speed ratio, the rotational speed ratio preferably lying at approximately 1 to 2. It goes without saying, however, that other rotational speed ratios are also likewise conceivable in a manner which deviates from this value, since the above-described rotational speed ratio describes only one possible embodiment.

The first and the second crankshaft can perform a sinusoidal rotational movement, the crankshafts being arranged relative to one another in such a way that the sinusoidal curves of their rotational movement have a phase shift of preferably approximately 90°.

It is known in principle from trigonometry that the functional values of a sinusoidal function on the unit circle can be projected into a Cartesian coordinate system, a circular line being produced around the zero point. It goes without saying that the same is also possible in the reverse direction. Accordingly, the respective force action points, at which the rotational movement of the first or the second crankshaft is transmitted to another element, likewise in each case describe a sinusoidal curve (called a sinusoidal rotational movement). If the two sinusoidal curves of the rotational movement of the first and the second crankshaft are compared, the sinusoidal curves can have a phase shift of approximately 90°. In the technical implementation, said phase shift corresponds to a shift of the force action points by 90° relative to one another.

It can be provided that the piston rod or at least an additional connecting part is mounted rotatably with a first eccentricity on the first crankshaft, and that the first crankshaft is mounted with a second eccentricity on the second crankshaft, the second eccentricity preferably being approximately four times as great as the first eccentricity.

Here, the eccentricity can be determined via the spacing of the rotational axes of the respective components from one another. In the case of the piston rod which does not perform a rotational movement, but rather converts the latter into a translational movement of the piston, the rotational axis corresponds to the center point of the connecting section, at which the piston rod is connected to the crankshafts.

Furthermore, the second crankshaft can have at least one seating region for seating and rotatably mounting the first crankshaft. It can additionally be provided in one development of the invention that the at least one additional connecting part can comprise a connecting rod and/or a lever. As a result of the provision of an additional connecting part, in particular, an improved introduction of force as a result of the utilization of a lever effect can be achieved, as a result of which the mounting of the components of the constant-volume combustion engine is subjected to lower maximum forces.

The rotational coupling of the first crankshaft with the second crankshaft can comprise at least one planetary gear stage with two spur gears which roll on one another and of which in each case one is assigned to one of the at least two crankshafts.

As an alternative or in addition, the rotational coupling of the first crankshaft to the second crankshaft can have at least one planetary gear stage with at least one spur gear which rolls on at least one internal gear of the planetary gear stage, the spur gear or the internal gear of the at least one planetary gear stage being assigned to one of the crankshafts and the respectively other component of the planetary gear stage being assigned to the respectively other crankshaft. A particularly space-saving arrangement of the rotational coupling of the crankshafts is achieved by way of a design of this type.

In this context, "assignment" does not mean that the component of the planetary gear stage has to be connected to the assigned crankshaft or has to be arranged on the latter. Instead, this results merely in the fact that each of the crankshafts of the constant-volume combustion engine can be functionally assigned at least one component of a planetary gear stage. An integral configuration of the component of a planetary gear stage with the assigned crankshaft or an arrangement of the component on the assigned crankshaft, however, has the advantage, in particular, of a particularly inexpensive and space-saving solution.

In addition to the above-described constant-volume combustion engine, the invention additionally relates to a method for operating a combustion engine as claimed in claim 11, which method is distinguished by the fact that the rotational movements of the coupled crankshafts are superimposed in such a way that the resulting total movement generates, in at least one defined angular section, a substantially constant position of the piston rod and the piston which is connected to it in the piston/cylinder unit. Here, a substantially constant position of the piston rod is a virtually constant position which makes it possible, for example during the power stroke, to provide a virtually unchanged combustion chamber in the piston/cylinder unit and therefore to ensure higher efficiency of the constant-volume combustion engine.

Furthermore, the crankshafts can be coupled to one another via at least one connecting part, for example a connecting rod and/or a rocker, the connecting part being capable of transmitting the superimposed movement of the crankshafts to the piston rod, and the crankshafts which are coupled to one another rotating relative to one another in the same direction and preferably with a predefined rotational speed ratio of approximately 1 to 2. It goes without saying that a deviation from the abovementioned rotational speed ratio is possible.

The rotational movements of the crankshafts can be sinusoids, the crankshafts being arranged relative to one another in such a way that the sinusoidal curves of their rotational movement have a phase shift of preferably approximately 90°.

In addition, the sinusoidal curves of the rotational movement of the crankshafts can have different amplitudes, the amplitude of the sinusoidal curve of the rotational movement of the second crankshaft preferably being four times as great as the amplitude of the sinusoidal curve of the rotational movement of the first crankshaft.

Finally, it can be provided that the defined angular section is assigned at least partially to the power or combustion stroke of the combustion engine, that is to say that stroke in which the fuel gas mixture is ignited and the fuel gas performs mechanical work on the piston.

In addition to the above-described method, the present invention also relates to the use of a constant-volume combustion engine as claimed in either of claims 16 and 17.

The invention will be described in more detail in the following text with reference to the appended figures, said figures illustrating preferred embodiments of the invention, in which the individual features of the invention are combined with one another. However, a person skilled in the art will also consider said features separately from one another and/or will be capable of combining them to form other appropriate combinations. Furthermore, a person skilled in the art can also gather further features of the invention which have possibly not yet been described in the above text from the following description of the figures and the claims.

Figure 1B:
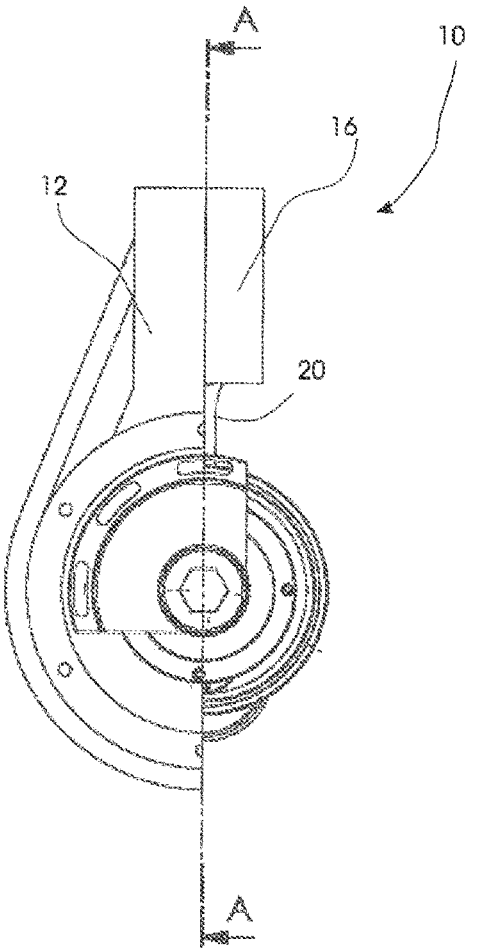
Figure 1C:
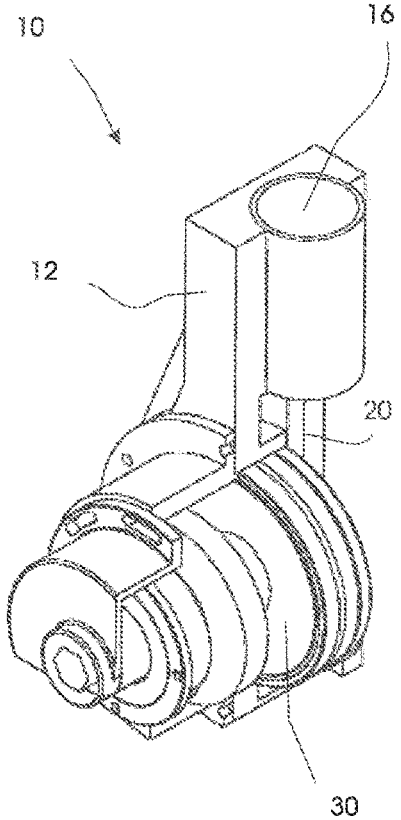
Figure 2A:
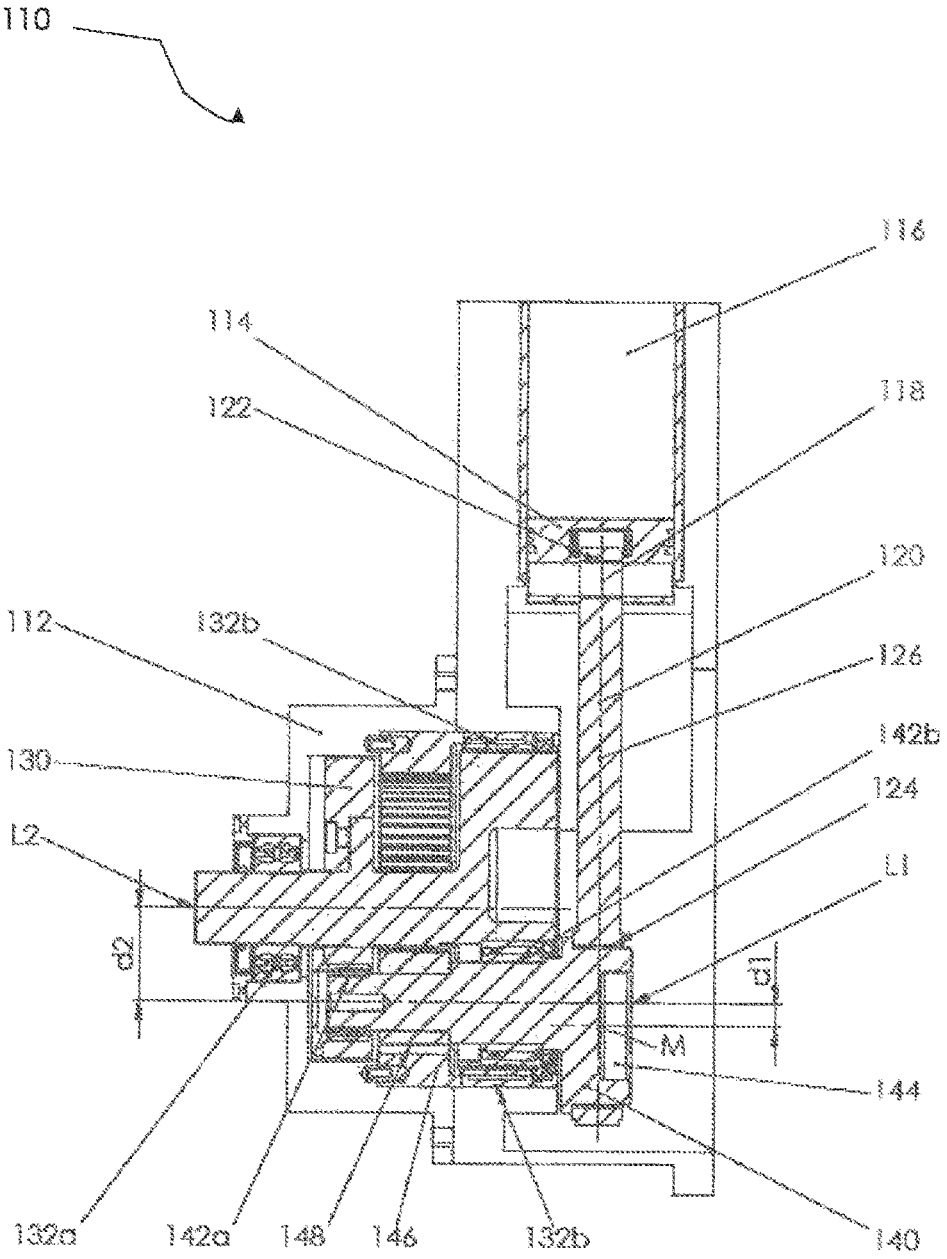
Figure 2B:
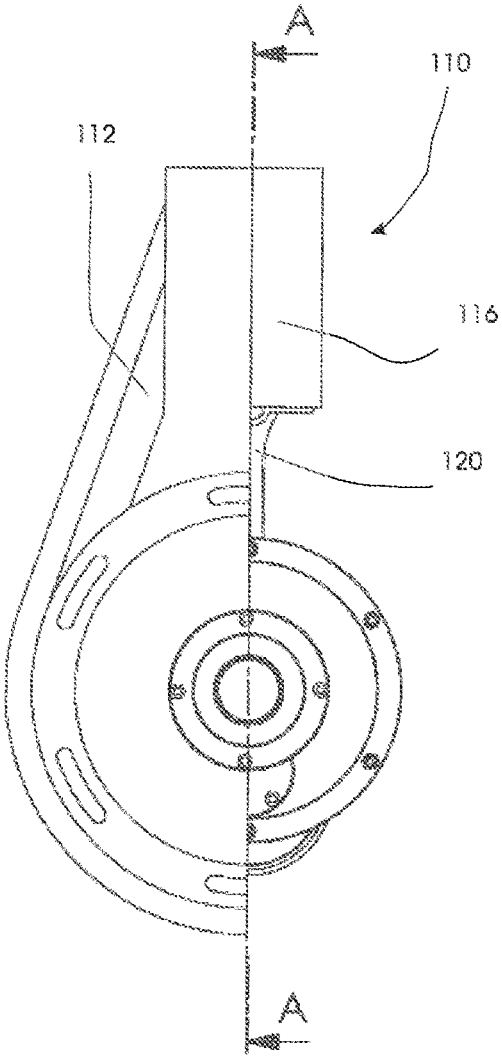
Figure 2C:
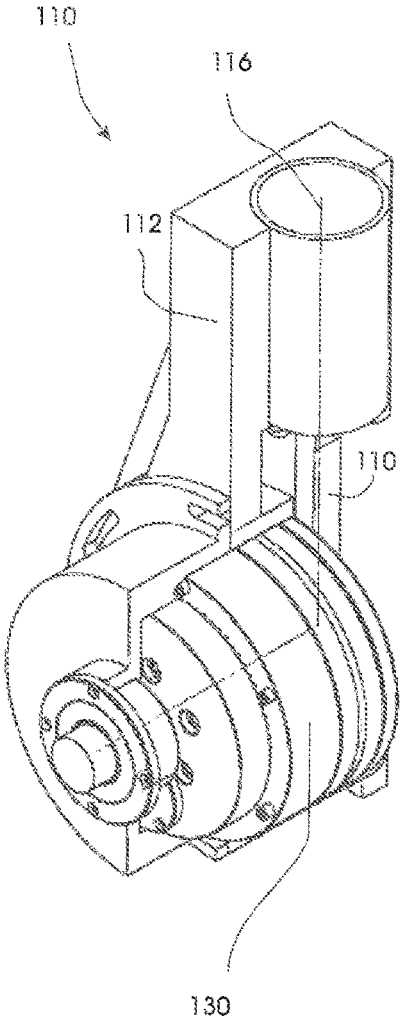
Figure 3A:
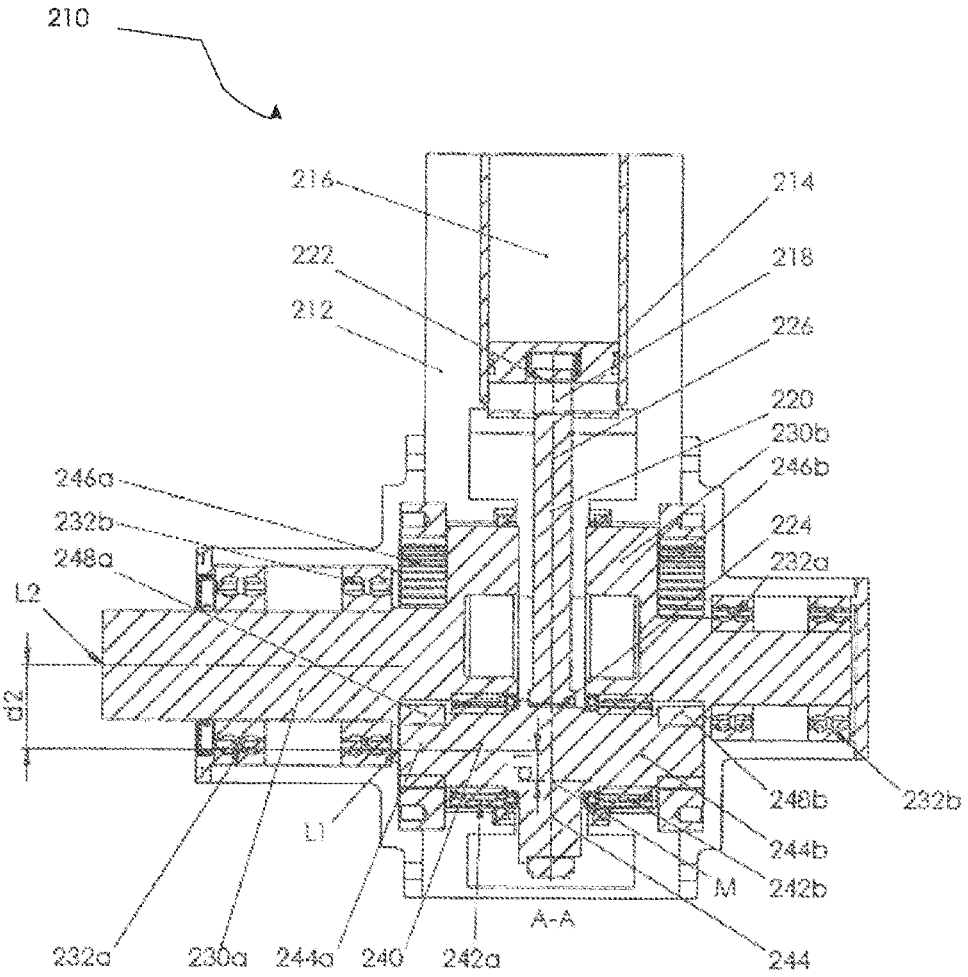
Figure 3B:
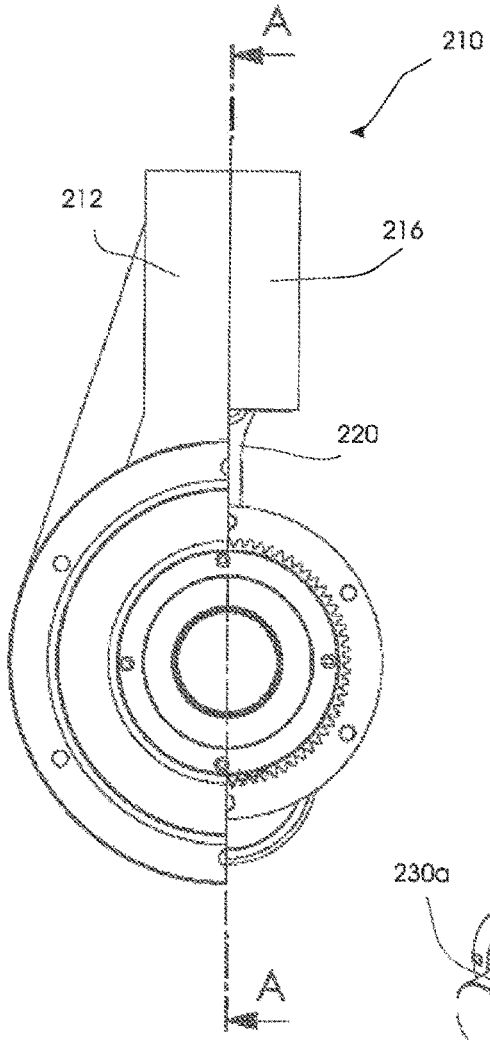
Figure 3C:
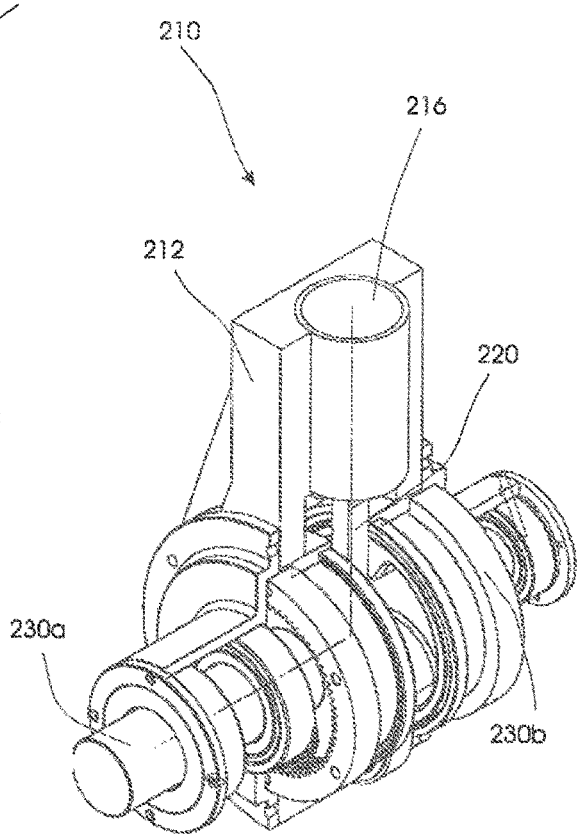

In the figures, diagrammatically:

FIGS. 1*a*-1*c* show different views of a constant-volume combustion engine according to the invention, in accordance with the first embodiment, FIGS. 2*a*-2*c* show different views of a constant-volume combustion engine according to the invention, in accordance with the second embodiment, and FIGS. 3*a*-3*c* show different views of a constant-volume combustion engine according to the invention, in accordance with a third embodiment.

FIGS. 1 to 3 show three different embodiments of a constant-volume combustion engine according to the invention. Here, identical features are denoted by the same designations, the numeral "1" being placed ahead of them in the second embodiment according to FIG. 2 and the numeral "2" being placed ahead of them in the third embodiment according to FIG. 3. Furthermore, the "a" figure in each case shows a sectional view of the respective constant-volume combustion engine according to the sectional line A-A in the associated "b" figure of the same embodiment of the constant-volume combustion engine. The "c" figure in each case illustrates the corresponding constant-volume combustion engine in an isometric partially sectioned view.

The constant-volume combustion engine according to FIGS. 1*a*-*c* is denoted generally by the designation 10 and, within a housing 12, comprises a piston/cylinder arrangement with a piston 14 which is received displaceably within a cylindrical receiving space 16 for the piston. Here, the piston 14 can be provided in a manner known per se with sealing means on its outer circumference, in order to delimit a working space or combustion space which is as sealed as possible within the cylindrical receiving space 16. Furthermore, the piston 14 is connected via a shaft-shaped connecting part 18 to a piston rod 20, by the shaft 18 being seated rotatably in a corresponding seating section 22 of the piston rod 20.

Furthermore, the piston rod 20 has a second seating section 24 for rotatable connection to a first crankshaft 40 and an intermediate web 26 which connects the seating sections 22 and 24 to one another.

The crankshaft system 28 which comprises a first crankshaft 40 and a second crankshaft 30 is essential to the invention. The two crankshafts 30, 40 in each case have a center longitudinal axis $L_1$ and $L_2$, respectively, about which they can rotate. The center longitudinal axes $L_1$ and $L_2$ therefore at the same time form the rotational axes for the respective crankshaft. The second crankshaft 30 is supported rotatably within the housing 12 via bearing points 32*a* and 32*b* which are customary per se. Said second crankshaft 30 has two eccentrically arranged seating regions 34*a* and 34*b*, in which the first crankshaft 40 is seated such that it can be rotated relative to the second crankshaft 30. The eccentric seating regions 34*a* and 34*b* are arranged eccentrically in relation to the longitudinal axis $L_2$ of the second crankshaft 30 and are configured so as to be aligned with one another. Depending on the design of the first crankshaft 40, the seating regions 34*a* and 34*b* can be configured with the same size or different sizes. As can be seen clearly in FIG. 1*a*, the crankshafts 30 and 40 are arranged parallel to one another.

In the first embodiment according to FIGS. 1*a*-*c*, furthermore, the second crankshaft 30 is configured as a hollow shaft, an intermediate shaft 36 being arranged in its interior and being configured so as to be fixed to the housing 12 so as to rotate with it. Here, the crankshaft 30 is supported on the intermediate shaft 36 via two bearing points 36*a* and 36*b* which are arranged on the inner circumference of the cavity which is defined by the second crankshaft 30. The second crankshaft 30 is therefore supported on the housing 16 to the outside via the outer bearing points 32*a* and 32*b* and on the intermediate shaft 36 which is fixed to the housing via the inner bearing points 36*a* and 36*b*.

Furthermore, a spur toothing system 38 is configured in the manner of a sun gear on the intermediate shaft 36, which spur toothing system 38 is in engagement with a corresponding gearwheel 48 of the first crankshaft 40. In the embodiment which is shown, the gearwheel 48 is pressed onto the first crankshaft 40, but as an alternative, however, can also be configured directly on said first crankshaft 40 or can be connected to it fixedly so as to rotate with it in some other way.

The first crankshaft 40 is seated eccentrically with respect to the second crankshaft 30 in the circular seating recesses 34*a* and 34*b* of said second crankshaft 30 which form the seating region, and is supported on the second crankshaft 30 by way of the bearing points 42*a* and 42*b* such that it can be rotated relative to said second crankshaft 30. The eccentricity is specified by way of the spacing $d_2$ between the center longitudinal axes $L_1$ and $L_2$.

Furthermore, the first crankshaft 40 has a shaft head 44 which is seated rotatably within the seating section of the piston rod 20. The shaft head 44 of the crankshaft 40 is of substantially circular configurations, the center point M of the circular shaft head 44 being arranged eccentrically with respect to the longitudinal axis $L_1$ and therefore the rotational axis of the first crankshaft 40 (the spacing between the center point M and the longitudinal axis $L_1$ is specified by $d_1$). Accordingly, the shaft head 44 and therefore also that seating section 24 of the piston rod 20 which surrounds said shaft head 44 perform an eccentric rotational movement relative to the crankshaft 40.

In the following text, the method of operation of the above-described constant-volume combustion engine 10 will be explained in greater detail:

According to the first embodiment of FIGS. 1*a-c*, the crankshaft arrangement 28 connects the second crankshaft 30 via a planetary gear stage to the first crankshaft 40. In said embodiment, the planetary gear stage comprises two spur gears 38, 48 which are in engagement with one another and roll on one another during a rotational movement. Therefore, the movement of the piston rod 20 is transmitted via the shaft head 44 to the first crankshaft 40 which, as a consequence, is capable of rolling on the spur gear 38 of the intermediate shaft 36 which is fixed to the housing and is thus capable of driving the second crankshaft 30 via the seating recesses 34*a* and 34*b* in a rotational movement which rotates about the intermediate shaft 36. Therefore, the second crankshaft 30 is driven by way of the movement of the piston rod 20 and the rotational movement of the first crankshaft 40 about the intermediate shaft 36, since the first crankshaft 40 is arranged eccentrically in the seating recesses 34*a* and 34*b* of the second crankshaft 30.

As a result of the specific eccentric arrangement of the first and the second crankshaft relative to one another, a superimposed total rotational movement is transmitted at the shaft head 44 to the piston rod 20 and the piston 14 which is connected to it, which total rotational movement is retarded with respect to a customary movement of the piston during the work stroke, that is to say at the top dead center of the piston 14. The specific eccentric arrangement of the first and the second crankshaft relative to one another likewise achieves a situation where the piston 14 performs an accelerated movement in the region of its bottom dead center.

It can be provided here that the spacing $d_2$ is approximately four times as great as the spacing $d_2$. Furthermore, the phase shift of the rotational movement of the first crankshaft 40 with respect to the rotational movement of the second crankshaft 30 can be approximately 90°. Finally, it can be provided that the rotational speed ratio of the first crankshaft to the second crankshaft lies at approximately 1 to 2, that is to say the first crankshaft 40 rotates approximately twice as rapidly as the second crankshaft 30.

As a result of the eccentric arrangement of the crankshaft arrangement 28 and the provision of a planetary gear stage, a particularly space-saving arrangement which makes a constant-volume process, as described in the description, possible is provided in the present case.

In contrast to the first embodiment, in the second embodiment according to FIGS. 2*a-c*, the first crankshaft 130 is not configured as a hollow shaft.

Instead of an intermediate shaft 36 which is fixed to the housing (cf. FIG. 1*a*), in the second embodiment of a constant-volume combustion engine 110 an internal gear 146 is provided which is likewise arranged within the housing 116 such that it is fixed to the housing and makes rolling of the spur gear 148 of the second crankshaft 140 possible. The remaining method of operation corresponds substantially to the first embodiment, for which reason reference is made to the comments which belong to said first embodiment.

Finally, FIGS. 3*a-c* show a further design variant, in which a two-sided mounting of the second crankshaft 240 is provided. To this end, the shaft head 244 of the second crankshaft 240 is arranged centrally on the latter and is flanked laterally by two shaft sections 244*a* and 244*b*. The latter in each case have, as did the above-described variants of FIGS. 1*a-c* and 2*a-c*, a spur gear 248*a*, 248*b* which is capable of rolling in each case on an internal gear 246*a*, 246*b* which is fixed to the housing. Furthermore, the second crankshaft is also of two-piece configuration in contrast to the above-described embodiments, and comprises the crankshaft 230*a* and the crankshaft 230*b* which are arranged in each case laterally with respect to the shaft head 244 of the first crankshaft 240. The remaining method of operation of the third embodiment corresponds as far as possible to the method of operation of the second embodiment according to FIGS. 2*a-c*, for which reason reference is made to the comments which belong to said second embodiment.

What is claimed is:

1. A constant-volume combustion engine, in particular a reciprocating piston engine for generating mechanical energy by way of expansion of a gas or a hot gas from the combustion of a gas mixture or gas/fuel mixture, having at least one piston/cylinder unit, the piston of which is connected to a piston rod, the piston rod being drive-connected to a first and a second crankshafts, wherein the first crankshaft is mounted eccentrically rotatably on the second crankshaft which is arranged parallel to it, and is rotationally coupled to said second crankshaft;

wherein the first and the second crankshafts perform a sinusoidal rotational movement, and the piston rod, or at least an additional connecting part, is mounted rotatably with a first eccentricity ($d_1$) on the first crankshaft, wherein the first crankshaft is mounted with a second eccentricity ($d_2$) on the second crankshaft, the second eccentricity ($d_2$) being between three and five times as great as the first eccentricity ($d_1$), the crankshafts being arranged relative to one another in such a way that the amplitude of the sinusoidal curve of the rotational movement of the second crankshaft is between three and five times as great as the amplitude of the sinusoidal curve of the rotational movement of the first crankshaft.

2. The constant-volume combustion engine as claimed in claim 1, wherein the rotational coupling of the first crankshaft to the second crankshaft comprises at least two gearwheels.

3. The constant-volume combustion engine as claimed in claim 1, wherein the first and the second crankshafts move in opposite directions to one another.

4. The constant-volume combustion engine as claimed in claim 1, wherein the second crankshaft has at least one seating region for seating and rotatably mounting the first crankshaft.

5. The constant-volume combustion engine as claimed in claim 4, wherein the at least one additional connecting part can comprise a connecting rod and/or a lever.

6. The constant-volume combustion engine as claimed in claim 1, wherein the at least one additional connecting part can comprise a connecting rod and/or a lever.

7. The constant-volume combustion engine as claimed in claim 1, wherein the rotational coupling can comprise at least one planetary gear stage and two spur gears which roll on one another and which are each assigned to one of the crankshafts.

8. The constant-volume combustion engine as claimed in claim 1, wherein the rotational coupling of the first and second crankshafts has at least one planetary gear stage with at least one spur gear which rolls on at least one internal gear of the planetary gear stage, the spur gear or the internal gear of the at least one planetary gear stage being assigned to one of the crankshafts and the respectively other being assigned to the respectively other crankshaft.

9. A method of using a constant-volume combustion engine as claimed in claim 1 as a generator or for driving a generator, wherein the engine operates a heat and power cogeneration plant or charges the battery of a vehicle.

10. A method for operating a combustion engine, in particular a reciprocating piston engine for generating mechanical energy by way of expansion of a gas or a hot gas from the combustion of the gas mixture or gas/fuel mixture, having at least one piston/cylinder unit, the piston of which is connected to a piston rod, the piston rod being drive-connected to and mounted rotatably with a first eccentricity ($d_1$) on a first crankshaft, the first crankshaft being coupled to a second crankshaft, wherein the first crankshaft is mounted with a second eccentricity ($d_2$) on the second crankshaft, the second eccentricity ($d_2$) being between three and five times as great as the first eccentricity ($d_1$) and wherein the rotational movements of the coupled crankshafts are superimposed in such a way that the resulting total movement generates, in at least one defined angular section, a substantially constant position of the piston rod and the piston which is connected to it in the piston/cylinder unit.

11. The method as claimed in claim 10, wherein the first and second crankshafts are coupled to one another via at least one connecting part, for example a connecting rod and/or a rocker, the connecting part being capable of transmitting the superimposed movement of the first and second crankshafts to the piston rod, and in that the crankshafts which are coupled to one another rotate relative to one another in the same direction and with a predefined rotational speed ratio.

12. The method as claimed in claim 10, wherein the defined angular section is assigned at least partially to the power or combustion stroke of the combustion engine.

* * * * *